US008673242B2

(12) United States Patent
Shick

(10) Patent No.: US 8,673,242 B2
(45) **Date of Patent: *Mar. 18, 2014**

(54) OVER-TORQUE RESISTANT VIAL

(75) Inventor: Leemen Loy Shick, Duluth, GA (US)

(73) Assignee: National Scientific Company, Rockwood, TN (US)

( * ) Notice: Subject to any disclaimer, the term of this patent is extended or adjusted under 35 U.S.C. 154(b) by 47 days.

This patent is subject to a terminal disclaimer.

(21) Appl. No.: 13/225,587

(22) Filed: Sep. 6, 2011

(65) Prior Publication Data

US 2013/0058844 A1 Mar. 7, 2013

(51) Int. Cl.
*B01L 3/14* (2006.01)

(52) U.S. Cl.
USPC ..... 422/550; 422/547; 422/549; 215/247; 215/321

(58) Field of Classification Search
USPC ..... 422/547, 548, 549, 550; 215/247, 316, 215/320, 321; 604/415
See application file for complete search history.

(56) References Cited

U.S. PATENT DOCUMENTS

| | | | | |
|---|---|---|---|---|
| 4,519,518 | A | 5/1985 | Wiles et al. | |
| 4,557,394 | A | 12/1985 | Luker | |
| 5,133,471 | A | 7/1992 | Pujol Almirall | |
| 5,871,111 | A | 2/1999 | Pfefferkorn et al. | |
| 7,168,581 | B2 * | 1/2007 | Robinson et al. | 215/349 |
| 7,527,161 | B2 | 5/2009 | Rodriguez et al. | |
| 2004/0131506 | A1 * | 7/2004 | Zurcher | 422/102 |

FOREIGN PATENT DOCUMENTS

| | | | |
|---|---|---|---|
| EP | 0 747 293 | A1 | 12/1996 |
| FR | 2 937 309 | A1 | 4/2010 |
| WO | 93/01098 | A2 | 1/1993 |

OTHER PUBLICATIONS

Thermo Fisher Scientific Inc., Drawing entitled Chemie-Verschluss DIN 45, dated Jan. 26, 2005 (1 page).
Thermo Fisher Scientific Inc., Drawing entitled Zusammenstellung Verschluss DIN 45, dated Jul. 27, 2004 (1 page).
Thermo Fisher Scientific Inc., Drawing entitled Schraubverschluss mit Originalitaet "zu Chemie-Verschluss", dated Jan. 19, 2005 (1 page).
Thermo Fisher Scientific Inc., Drawing entitled Chemieflasche 100 ml, dated Feb. 14, 2005 (1 page).
Thermo Fisher Scientific Inc., Drawing entitled Spezialmundung 45 mm, dated Mar. 13, 2007 (1 page).
Espacenet, English Machine Translation of Application No. FR2937309A1, retrieved from http://worldwide.espacenet.com on Apr. 19, 2013 (10 pages).
European Patent Office, International Search Report and Written Opinion of the International Searching Authority, International Application No. PCT/US2012/051075, mailed on Nov. 9, 2012 (11 pages).
International Searching Authority, International Search Report and Written Opinion of the International Searching Authority, International Application No. PCT/US13/52289, mailed on Aug. 26, 2013 (12 pages).

* cited by examiner

*Primary Examiner* — Jill Warden
*Assistant Examiner* — Dwayne K Handy
(74) *Attorney, Agent, or Firm* — Wood, Herron & Evans, LLP

(57) ABSTRACT

An over-torque resistant vial and closure assembly includes a vial having an outwardly projecting rib that cooperates with a stop surface provided on a closure. When the closure is threadably coupled to the vial, the stop surface of the closure engages the outwardly projecting rib of the vial so as to prevent over-torquing of the closure onto the vial.

15 Claims, 6 Drawing Sheets

OVER-TORQUE RESISTANT VIAL

FIELD OF THE INVENTION

The present invention relates generally to vial and closure assemblies and, more particularly, to a vial and a closure having a piercable septum or liner.

BACKGROUND OF THE INVENTION

Screw thread vials and closures are commonly used in laboratory applications for which effective sealing with near zero evaporation is important. When using conventional vial and closure assemblies, a user must be careful to apply a correct amount of torque when securing the closure to the vial. If a user fails to apply the correct amount of torque, then the assembly may fail to perform properly due to a non-uniform seal formed between the vial and closure. That is, fluids may escape from the vial via spillage and/or evaporation when a fluid-tight seal is not initially created or maintained.

Gas chromatography and high performance liquid chromatography applications are examples of laboratory techniques for which air-tight vial and closure assemblies are essential. The closures of chromatography vials often comprise a closure fitted with a piercable septum. When the closure is tightened onto the vial, the septum is compressed between the top wall of the closure and the rim of the vial to provide a fluid-tight compression seal. Chromatography vials are often very small, such as 9 mm or 12 mm for example, and are typically constructed of glass or plastic.

Most solvents used in chromatography have a low vaporization point. It is important to have an effective compression seal against evaporation of the solvents used in gas chromatography and in high performance liquid chromatography applications. Particularly due to the small size of chromatography vials, it is oftentimes difficult to apply a consistent amount of torque to a plurality of closure and vial assemblies, i.e., from one to the next, particularly when multiple operators are handling the plurality of assemblies. If a closure is tilted in relation to the vial, a non-uniform or ineffective seal may occur with the vial rim that permits solvent evaporation. Even small amounts of evaporation may greatly affect the concentration of one or more solutes in the low volumes of solvent contained within the small vials. Moreover, tilting of the closure may complicate lifting of the vial by robotic handling systems used in conventional autosamplers.

Another common problem with conventional chromatography vials provided with closures having piercable septums is that over-tightening of the closure with respect to the vial may result in at least a partial extrusion of the septum away from the sealing surfaces. This further reduces the likelihood of creating an effective fluid-tight seal.

Vial and closure assemblies used for chromatography must also be capable of fully resealing after the septum is initially punctured. That is, when a needle penetrates and is withdrawn from the septum, the septum must resist being pushed through or being withdrawn from the cap. Such extrusion or withdrawal causes the seals to fail, increases the loss of solvent through evaporation and, thus, renders inaccurate results in chromatography applications using these vials of solvents.

Furthermore, over-torquing the closure with respect to the vial may create non-uniform, radial tension on the septum so that the septum does not present a generally planar piercing surface. This increases the risk of septum coring and/or needle bending in chromatography or autosampler instruments.

Because conventional vial and closure assemblies have not provided satisfactory solutions to the problems associated with over-torque forces applied thereupon, there remains a need for a vial and closure assembly that is capable of resisting an application of excessive torque or non-uniform seal between the vial and the closure, particularly for small vials.

SUMMARY OF THE INVENTION

The present invention overcomes the foregoing problems and other shortcomings and drawbacks of known vial and closure assemblies. While the present invention will be described in connection with certain embodiments, it will be understood that the present invention is not limited to these embodiments. To the contrary, this invention includes all alternatives, modifications, and equivalents as may be included within the spirit and scope of the present invention.

According to one embodiment of the present invention, an over-torque resistant vial and closure assembly is provided comprising a vial having an open end defined by a vial rim and at least one outer thread located proximate the open end of the vial.

The vial further includes an outwardly projected rib provided on the vial with the outer thread being located between the outwardly projecting rib and the vial rim. The outwardly projecting rib and the outer thread provided on the vial have respective first and second maximum width dimensions extending outwardly from an outer surface of the vial, with the first maximum width dimension being greater than the second maximum width dimension.

The closure is configured to be received by the open vial and comprises, in one embodiment, a top wall, a skirt wall having an inner surface and depending from the top wall, an inner thread provided on the inner surface of the skirt wall, and a stop surface provided on the inner surface of the skirt wall, with the inner thread being located between the stop surface and the top wall of the closure.

The stop surface provided on the closure is configured to engage the outwardly projecting rib when the closure is threadably coupled to the vial so as to prevent advancement of the closure upon application of a torquing force onto the closure.

In one embodiment, the closure has an opening formed therethrough and further comprises a septum positioned adjacent the top wall of the closure that is at least partially exposed through the opening. The septum is configured to create a fluid-tight seal with a vial rim when the closure is threadably coupled to the vial.

In an alternative embodiment, the closure has a closed top without an opening formed therethrough. A liner is provided between the closure and the vial rim to create a fluid tight seal when the closure is fully torqued onto the vial.

In accordance with the principles of the invention, the outwardly projecting rib provided on the vial and the stop surface provided on the closure are configured to cooperate when the closure is threadably coupled to the vial so that a generally constant and uniform force is applied to the septum or liner around the circumference of the vial rim.

The cooperation of the stop surface of the closure with the outwardly projecting rib of the vial also provides a settling surface for the horizontal alignment of the closure on the vial to reduce tilting of the closure relative to the vial. This allows a lower rim of the closure to be aligned in a generally horizontal plane when the closure is fully torqued onto the vial so as to provide a consistent horizontal lifting surface for an arm of a robotic handling system commonly used in autosamplers and other laboratory equipment.

The cooperation of the stop surface of the closure with the outwardly projecting rib of the vial also prevents over-tightening of the closure onto the vial, which may lead to deformation and/or extrusion of the septum from effective sealing contact with the vial rim. Deformation and/or extrusion of the septum reduces the fluid-tight seal of the assembly and may allow for undesirable evaporation of the solvents within the vial.

In addition, the generally uniform compression force applied to the septum around the circumference of the vial rim ensures that the septum creates a substantially planar piercing surface at the open end of the vial. The planar piercing surface reduces the risk of septum coring and/or bending of a needle of a chromatography or autosampler instrument.

The above and other objectives of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF THE INVENTION

Figure 1:
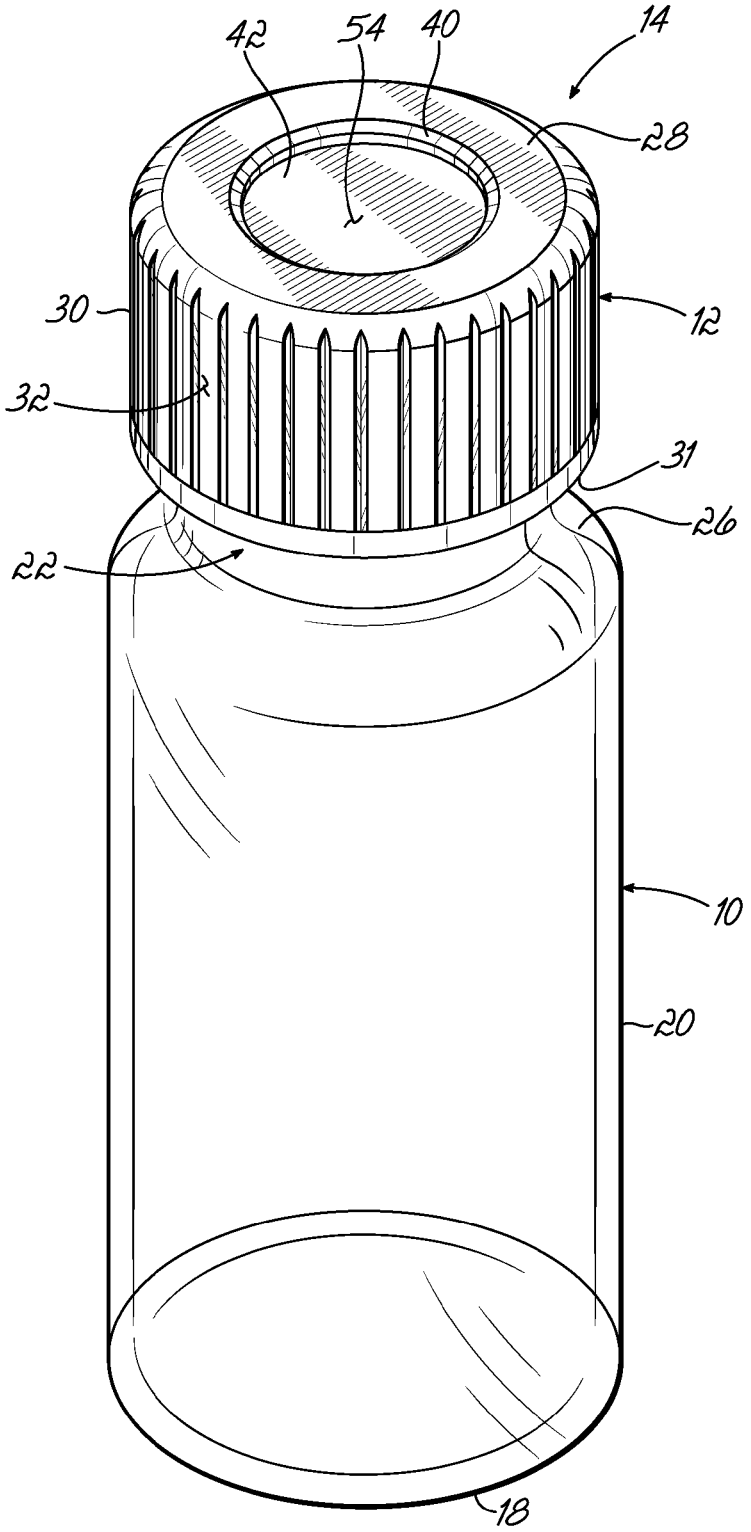
FIG. 1 is a perspective view of a vial and closure assembly in accordance with one embodiment of the present invention.
Figure 2:
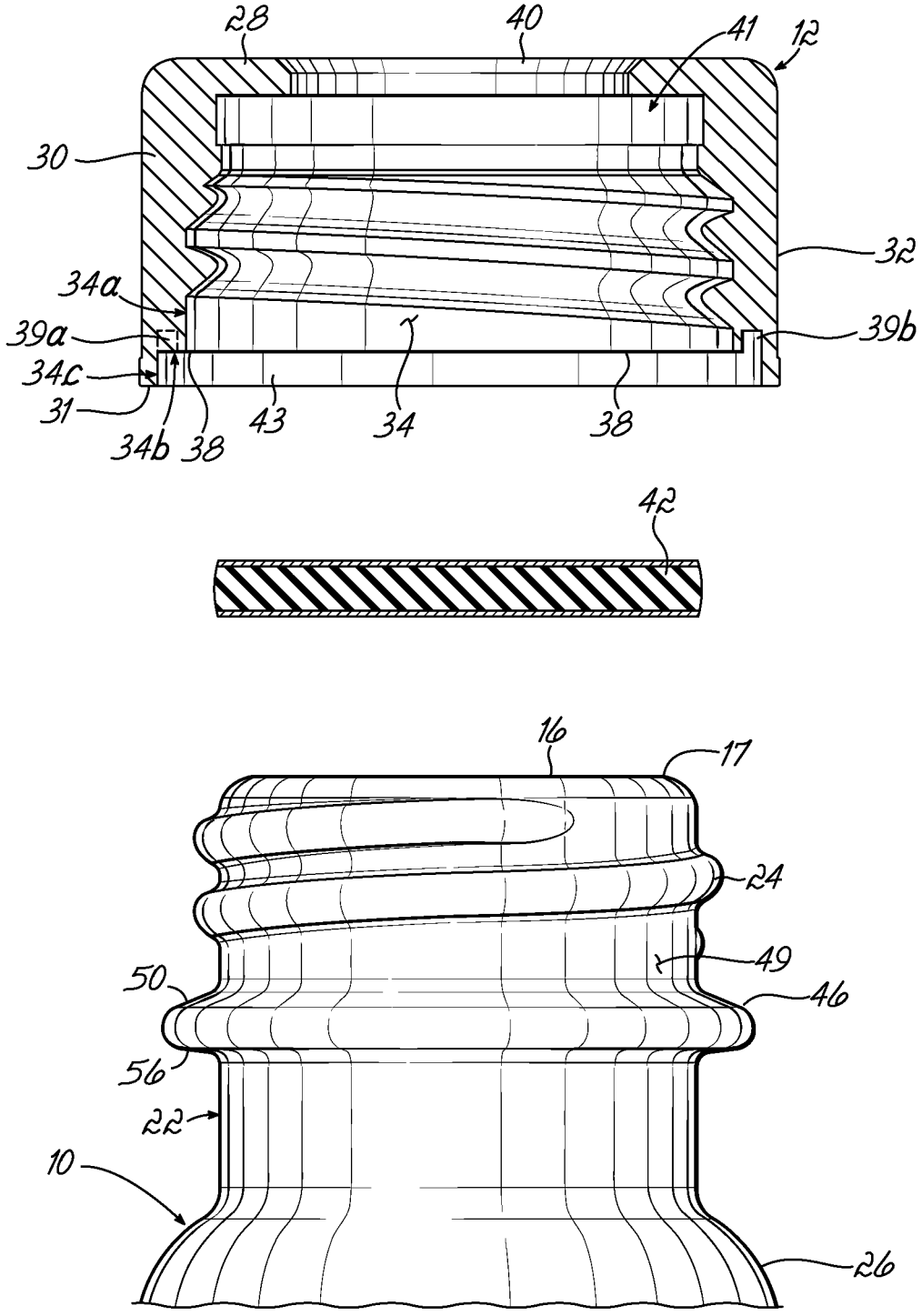
FIG. 2 is a side-elevational view of vial and closure assembly of FIG. 1, showing the vial and closure disassembled.

Turning now to the figures, and in particular to FIGS. 1 and 2, a vial 10 and a closure 12, collectively referred to as a vial and closure assembly 14, are shown according to one embodiment of the present invention. The vial 10 and the closure 12 may be configured as a labware product, such as a 2 mL chromatography vial for example, for use with manual or automatic (including robotic) analytical instruments.

In one embodiment, the vial 10 is comprised of a hollow structure for the containment of a fluid and includes an open end 16 defined by a vial rim 17 (FIGS. 4 and 5) and a closed end 18. The open end 16 of the vial 10 may be generally circular and the hollow structure of the vial 10 may be constructed of glass, plastic, or other suitable material that is inert with respect to the fluid contained therein.

An outer surface of the vial 10 proximate the open end 16 (FIG. 3) may include at least one outer thread 24 (FIGS. 2-5) comprising, for example, an 8-425 thread, a 9-425 or 9 mm thread, a 10-425 thread, or any other suitable thread configuration that is configured to threadably couple with the closure 12. In the illustrated embodiment of FIGS. 2-5, the outer thread 24 of the vial 10 is a single thread. It will be readily appreciated that, in other embodiments, a series of multiple outer threads 24 may be used in place of a single, continuous outer thread 24. The outer thread 24 may further comprise a single turn or multiple turns of the vial 10. In one embodiment, the thread 24 comprises a 1½ turn. As shown, the outer thread 24 is located on a neck 22 and extends down at least a portion of the neck 22. In this way, when the closure 12 is fully secured onto the vial 10, an uncovered portion 44 (FIG. 5) of the neck 22 remains.

Figure 3:
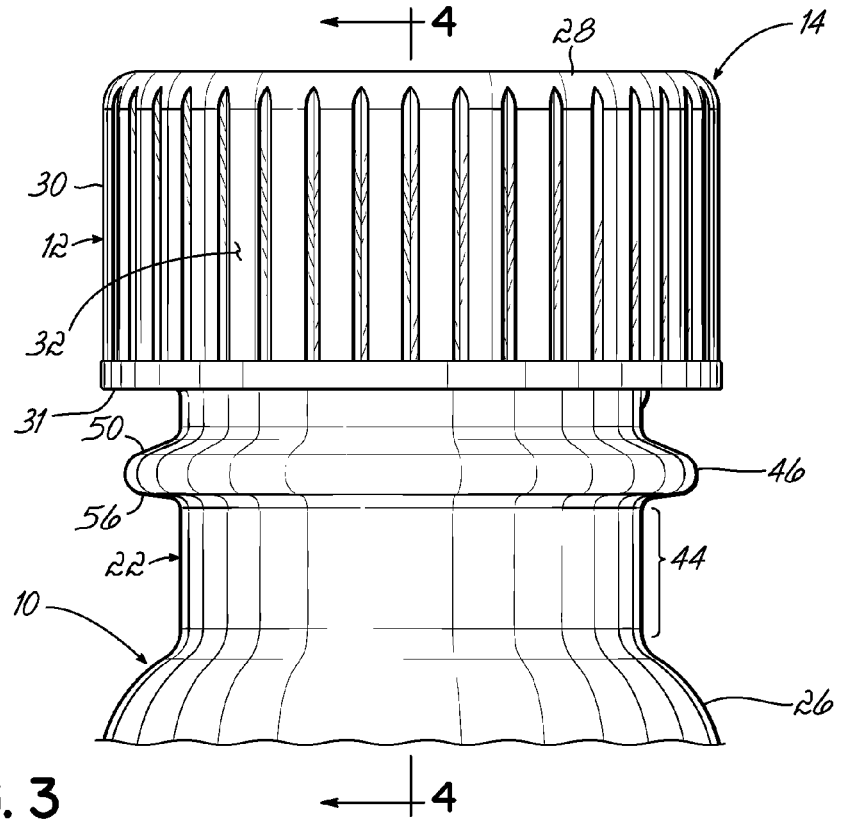
FIG. 3 is a side-elevational view of the vial and closure assembly of FIG. 1 in an assembled but non-fully torqued position.

Referring now to FIGS. 1-3, in some embodiments, such as the particular illustrative vial 10, the hollow structure of the vial 10 may include a body portion 20 and the neck 22 which extends substantially downward from the open end 16 of the vial 10. The neck 22 has an outer diameter that is generally smaller than an outer diameter of the body portion 20.

The vial 10 may also include a shoulder 26 at a base of the neck 22. The shoulder 26 forms a transition between the neck 22 and the body portion 20 and, therefore, may have an outer diameter that increases between the smaller, outer diameter of the neck 22 and the larger, outer diameter of the body portion 20. One particular advantage of the illustrative vial shape, including the neck 22 and shoulder 26, is that the shape facilitates manipulation by robotics, such as robotic chromatographs, autosamplers, and other laboratory instrumentation, as described in detail below.

Referring still to FIGS. 1 and 2, the closure 12 is constructed so as to be received by the open end 16 of the vial 10. The closure 12 has a top wall 28 and a skirt wall 30 that depends from the top wall 28. The skirt wall 30 terminates in a rim 31 that is located opposite the top wall 28. An outer surface 32 of the skirt wall 30 may have ridges or another textured surface to facilitate gripping of the closure 12 for turning of the closure 12 relative to the vial 10. An inner surface 34 of the skirt wall 30 of the closure 12 may have a portion **34*a* (FIG. 2) that is generally circular in cross section and has a diameter that is slightly larger than the outer diameter of the open end 16 of the vial 10. The skirt wall 30 of the closure 12 includes at least one inner thread 36 (FIG. 4) provided on the inner surface portion 34*a* that is configured to threadably cooperate with the outer thread 24 (FIG. 4) provided on the vial 10**.

Figure 4:
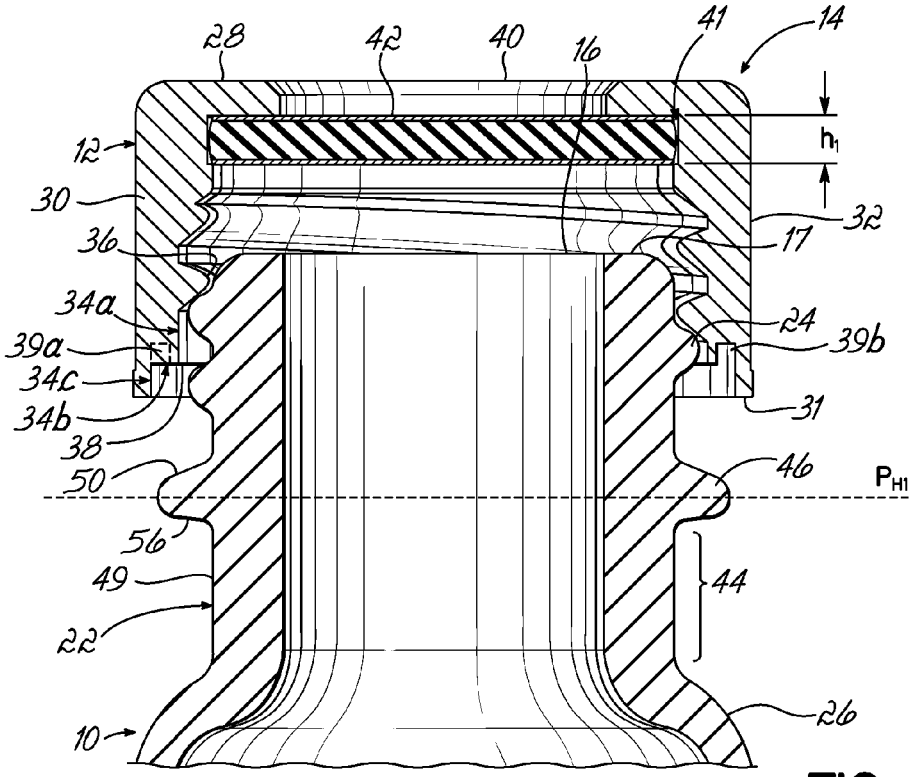
FIG. 4 is a cross-sectional view taken along the line 4-4 of FIG. 3.
Figure 9:
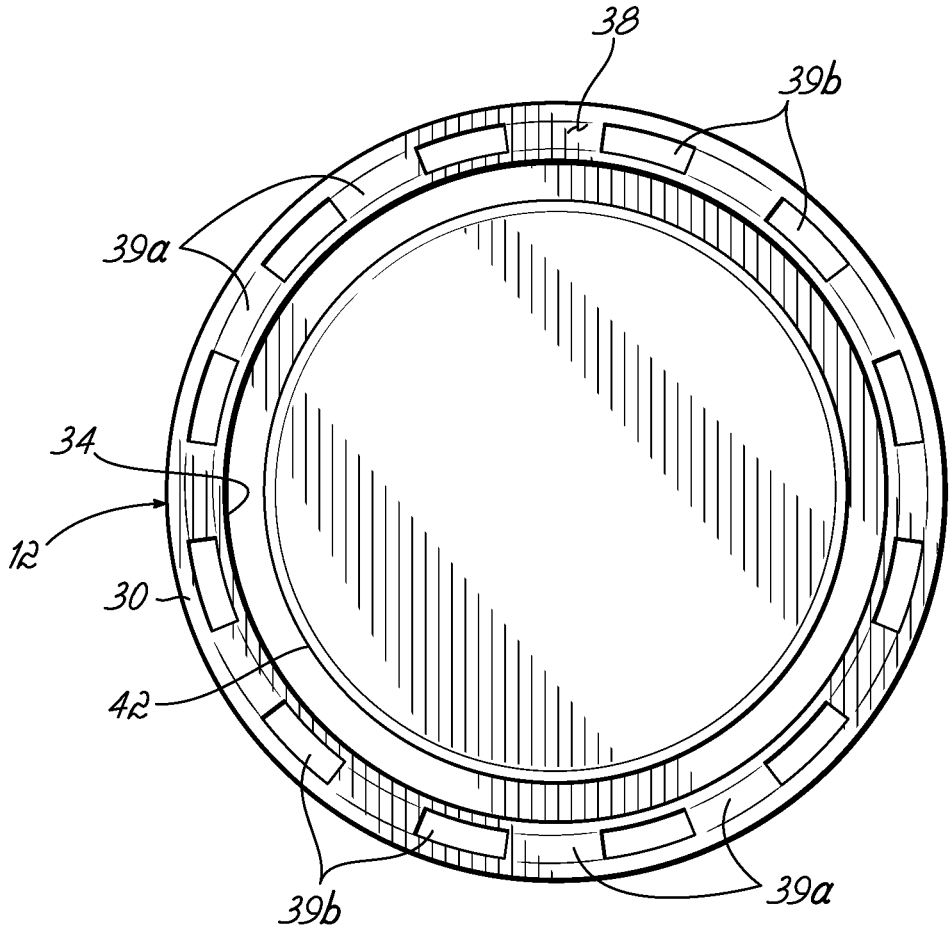
FIG. 9 is a bottom view of the closure shown in FIG. 1, with an inner thread of the closure removed for clarity.

In accordance with one aspect of the present invention, the skirt wall 30 further includes a stop surface 38 (FIGS. 2, 4 and 5) provided on a portion **34*b* (FIGS. 2 and 4) of the inner surface 34 of the skirt wall 30 such that the inner thread 36 is located between the stop surface 38 and the top wall 28 of the closure 12. In one embodiment, the stop surface 38 is integrally formed in the skirt wall 30 and is formed generally as a plurality of discrete, circumferentially spaced ledges 39*a* that are separated by a plurality of discrete, circumferentially spaced cavities 39*b* as shown in FIGS. 2, 4 and 9. The stop surface 38 forms a radially expanding transition between the portion 34*a* of the inner surface 34 of the skirt wall and a cylindrical surface 43 (FIG. 2) provided on a portion 34*c* (FIG. 2) of the inner surface 34 that has a diameter greater than the diameter of the inner surface portion 34*a* of the skirt wall 30 and extends from the stop surface 38 to the rim 31**.

In the illustrative embodiment, the closure 12 includes an opening 40 formed through the top wall 28 and a septum pocket 41 (FIGS. 2, 4 and 5) communicating with the opening 40. The septum pocket 41 is configured to receive and retain a compressible septum 42 so that the septum 42 is at least partially exposed through the opening 40. When the vial 10 and the closure 12 are fully assembled, the septum 42 is compressed between the vial rim 17 and the top wall 28 of the closure 12 so that the septum 42 engages and creates a fluid-tight compression seal with the vial rim 17 so as to minimize evaporation of solvents from within the vial.

In an alternative embodiment (not shown), the closure 12 has a closed top without the opening 40 formed through the top wall 28. Rather than a septum 42, a conventional liner (not shown) may be provided between the top wall 28 of the closure 12 and the vial rim 17. When the vial 10 and the closure 12 are fully assembled, the liner (not shown) is compressed between the vial rim 17 and the top wall 28 of the closure 12 so that the liner (not shown) engages and creates a fluid-tight with the vial rim.

In accordance with another aspect of the present invention, and as shown in FIGS. 2-5, the neck 22 of the vial 10 includes an outwardly projecting rib 46 which extends circumferentially around the neck 22 in one embodiment.

Figure 5:
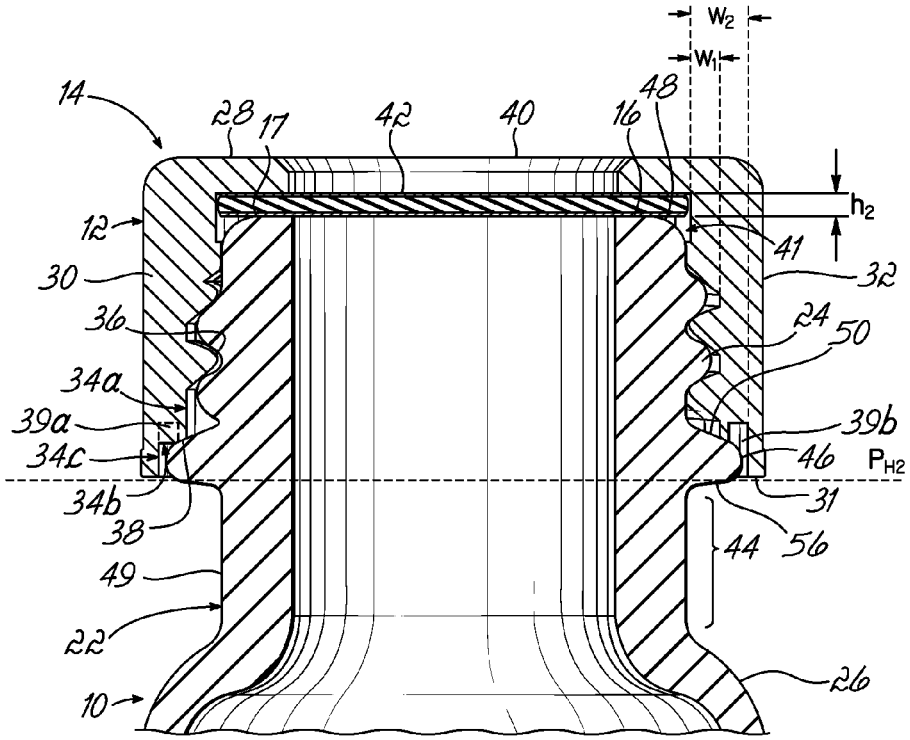
FIG. 5 is a view similar to FIG. 4 showing the vial and closure assembly in a fully torqued position.
Figure 8:
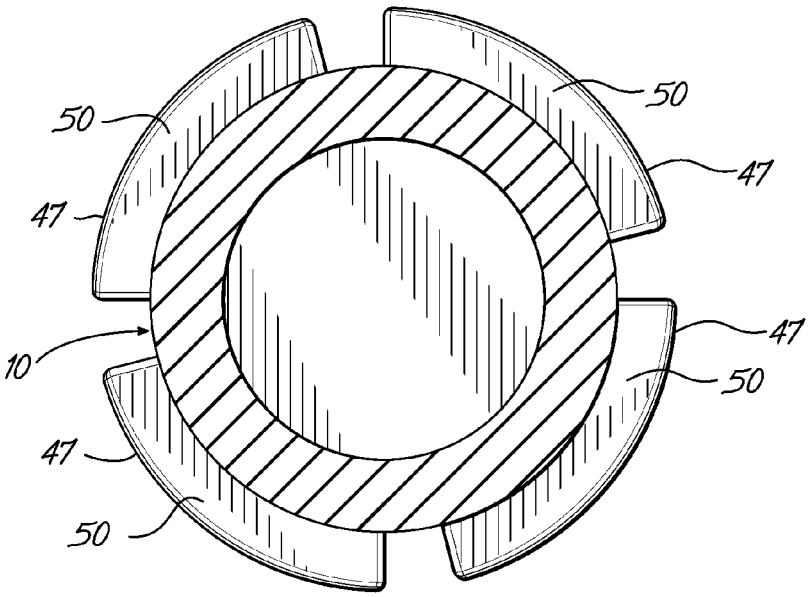
FIG. 8 is a cross-sectional view of a vial according to another aspect of the present invention having a discontinuous outwardly projecting rib.

The outwardly projecting rib 46 may be either a single continuous rib, as shown in FIGS. 2-5, or one or more discontinuous ribs 47 as shown in the alternative embodiment of FIG. 8. As shown in FIG. 5, the outer thread 24 and the outwardly projecting rib 46 have respective maximum width dimensions "$W_1$" and "$W_2$" with respect to an outer surface 49 of the neck 22, with the maximum width dimension "$W_2$" being greater than the maximum width dimension "$W_1$." The outwardly projecting rib 46 lies in a generally horizontal plane "$P_{H1}$" (FIG. 4) that is parallel to the vial rim 17 and may be constructed from the same material as the vial 10, e.g., a bead of glass formed on a glass vial or a bead of plastic formed on a plastic vial. In one embodiment, the outwardly projecting rib 46 is asymmetrical, when viewed in cross section, relative to the generally horizontal plane "$P_{H1}$" extending through the maximum width dimension "$W_2$" of the outwardly projecting rib 46 as shown in FIG. 4. In the embodiment shown in FIGS. 2-5, the outwardly projecting rib 46 is located on the neck 22 above the shoulder 26 of the vial 10. Accordingly, when the closure 12 is fully secured to the vial 10, the uncovered portion 44 of the neck 22 remains.

The outwardly projecting rib 46 creates a stop surface 50 (FIGS. 2-4) that engages the stop surface 38 of the closure 12 when the closure 12 is threadably coupled to the vial 10. More particularly, the closure 12 may be positioned on the open end 16 of the vial 10 and threadably coupled with the outer thread 24 of the vial 10 until the stop surface 38 of the closure 12 engages the stop surface 50 of the outwardly projecting rib 46. In this way, the cooperation of the stop surface 38 of the closure 12 with the stop surface 50 of the outwardly projecting rib 46 prevents advancement of the closure 12 toward the closed end 18 of the vial 10 upon application of a torquing force onto the closure 12. This cooperation ensures a generally constant and uniform force is applied to the septum 42 around the circumference of the vial rim 17 for each of a plurality of assembled vials 10 and closures 12 to provide an effective compression seal against evaporation. In this way, over-tightening of the closure 12, which may lead to deformation and/or extrusion of the septum 42 from effective sealing contact with the vial rim 17, is prevented. Deformation and/or extrusion of the septum 42 reduces the fluid-tight seal of the assembly and may allow for undesirable evaporation of the solvents within the vial 10. In addition, the generally uniform compression force applied to the septum 42 around the circumference of the vial rim 17 ensures that the septum 42 creates a substantially planar piercing surface 54 at the open end 16 of the vial 10. The planar piercing surface 54 reduces the risk of septum 42 coring and/or bending of a needle (not shown) of a chromatography or autosampler instrument.

In one exemplary embodiment, as shown in FIG. 4, the septum 42 may have an uncompressed height or thickness "$h_1$" of about 1.02 mm. When the closure 12 is fully torqued to the vial 10, as described above, the septum 42 may have a compressed height or thickness "$h_2$" of about 0.57 mm as shown in FIG. 5.

The cooperation of the stop surface 38 of the closure 12 with the stop surface 50 of the outwardly projecting rib 46 also provides a settling surface for the horizontal alignment of the closure 12 on the vial 10 to reduce tilting of the closure 12 relative to the vial 10. In this way, the rim 31 of the closure 12 is aligned in a generally horizontal plane "$P_{H2}$" (FIG. 5) that is coincidental with a generally flattened annular surface 56 (FIGS. 2-5) provided on the outwardly projecting rib 46 opposite the stop surface 50 when the closure 12 is fully torqued to the vial 10 so as to provide a consistent horizontal lifting surface for an arm (not shown) of a robotic handling system commonly used in chromatography or autosampler instruments. In addition, the planar piercing surface 54 provides a more consistent thickness of septum material to be penetrated, which applies less resistant force to the needle.

By preventing further advancement of the closure 12 toward the closed end 18 of the vial 10 in response to over-torquing forces applied to the closure 12, the cooperation of the stop surface 38 of the closure 12 with the stop surface 50 of the outwardly projecting rib 46 ensures that the portion 44 of the neck 22 remains uncovered beneath the rim 31 of the closure 12. The uncovered neck 44 and shoulder portion 26 facilitate alignment and movement of the vial 10 by an arm (not shown) of a robotic handling system (not shown). That is, the arm may grasp the vial 10 between the rim 31 of the closure 12 and the shoulder 26 while a torquing device (not shown) of the robotic handling system applies a torquing force onto the closure 12 so as to couple or remove the closure 12 from the vial 10. Furthermore, the rim 31 of the closure 12 may further facilitate movement of the vial 10 within the robotic handling system, e.g., the arm of the robotic handling system may reside against the rim 31 of the closure 12 and apply an upwardly directed force thereto for lifting the vial 10.

Figure 6:
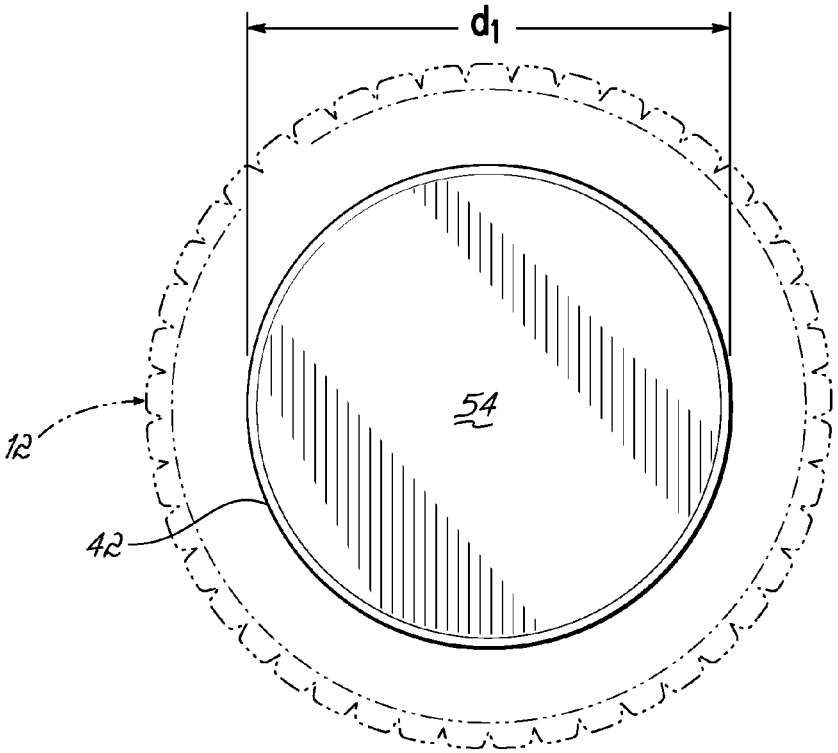
FIG. 6 is a top view of the vial and closure assembly of FIG. 3 showing an uncompressed septum.
Figure 7:
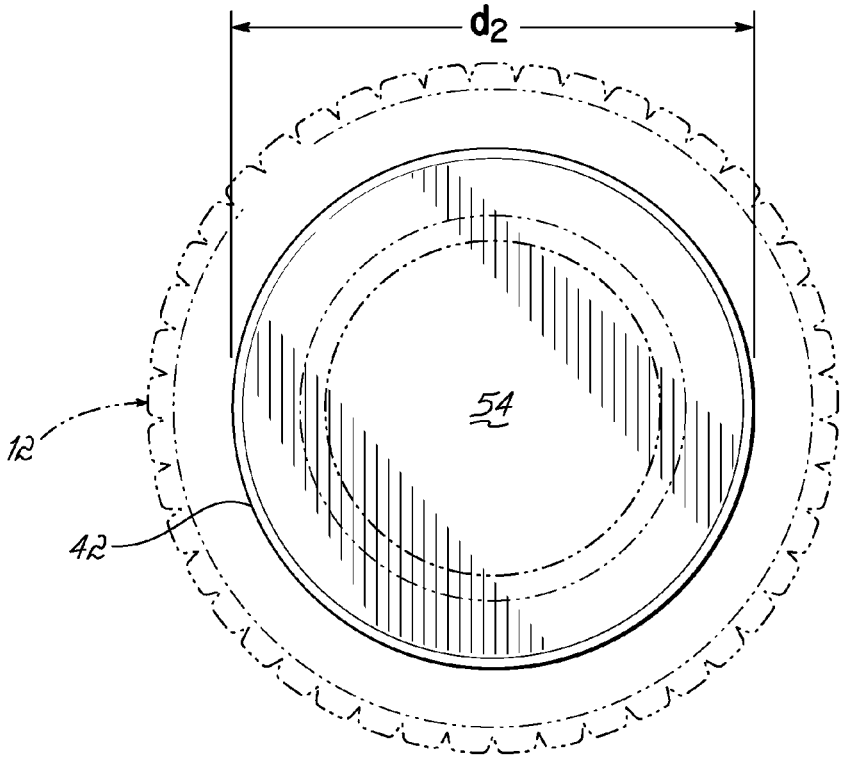
FIG. 7 is a top view of the vial and closure assembly of FIG. 5 showing a compressed septum.

FIGS. 6 and 7 show the vial and closure assembly 14 in un-torqued and torqued positions, respectively. In the un-torqued position, as shown in FIG. 6, the septum 42 has a diameter "$d_1$". In the torqued position, as shown in FIG. 7, the stop surface 38 of the closure 12 engages the outwardly projecting rib 46, and the septum 42 is axially expanded to an increased diameter "$d_2$" to form a fluid-tight seal between the vial 10 and the top wall of the closure 12.

While the present invention has been illustrated by a description of various embodiments, and while these embodiments have been described in some detail, they are not intended to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with methods of practicing the present invention as currently known. However, the invention itself should only be defined by the appended claims.

What is claimed is:

1. An over-torque resistant vial and closure assembly, comprising:

a vial having an open end defined by a vial rim and at least one outer thread located proximate the open end of the vial;

an outwardly projecting rib located adjacent the at least one outer thread provided on the vial with the at least one outer thread being located between the outwardly projecting rib and the vial rim, the outwardly projecting rib and the at least one outer thread having respective first and second maximum width dimensions extending outwardly from an outer surface of the vial, with the first maximum width dimension being greater than the second maximum width dimension; and a closure configured to be received by the open end of the vial and comprising:

a top wall;

a skirt wall having an inner surface and depending from the top wall;

an inner thread provided on the inner surface of the skirt wall; and a stop surface provided on the inner surface of the skirt wall, with the inner thread being located between the stop surface and the top wall of the closure, wherein the stop surface is configured to engage the outwardly projecting rib when the closure is threadably coupled to the vial so as to prevent advancement of the closure upon application of a torquing force onto the closure.

2. The vial and closure assembly of claim 1, wherein the top wall of the closure has an opening formed therethrough and further comprises:

a septum positioned adjacent the top wall of the closure and being at least partially exposed through the opening, wherein the septum creates a fluid tight seal with the vial rim when the closure is threadably coupled to the vial.

3. The vial and closure assembly of claim 1, wherein the open end of the vial further comprises a neck having the at least one outer thread located on the neck.

4. The vial and closure assembly of claim 1, wherein the outwardly projecting rib is continuous about the circumference of the vial neck.

5. The vial and closure assembly of claim 2, wherein the outwardly projecting rib provided on the vial and the stop surface provided on the closure are configured to cooperate when the closure is threadably coupled to the vial so that a generally constant force is applied to the septum around the circumference of the vial rim.

6. The vial and closure assembly of claim 1, wherein the skirt wall terminates in a rim located opposite the top wall of the closure, and further wherein the outwardly projecting rib provided on the vial and the stop surface provided on the closure are configured to cooperate when the closure is threadably coupled to the vial so that the rim of the skirt wall is aligned generally in a horizontal plane.

7. An over-torque resistant vial and closure assembly, comprising:

a vial having an open end defined by a vial rim and at least one outer thread located proximate the open end of the vial;

an outwardly projecting rib provided on the vial with the at least one outer thread being located between the outwardly projecting rib and the vial rim, the outwardly projecting rib and the at least one outer thread having respective first and second maximum width dimensions extending outwardly from an outer surface of the vial, with the first maximum width dimension being greater than the second maximum width dimension; and a closure configured to be received by the open end of the vial and comprising:

a top wall;

a skirt wall having an inner surface and depending from the top wall;

a septum pocket provided in the top wall;

an opening formed through the top wall;

an inner thread provided on the inner surface of the skirt wall;

a stop surface provided on the inner surface of the skirt wall and extending about the circumference of the skirt wall, with the inner thread being located between the stop surface and the top wall of the closure; and a septum positioned within the septum pocket and being at least partially exposed through the opening, wherein the stop surface is configured to engage the outwardly projecting rib when the closure is threadably coupled to the vial so as to prevent advancement of the closure upon application of a torquing force onto the closure.

8. The vial and closure assembly of claim 7, wherein the stop surface comprises a plurality of discrete, circumferentially spaced ledges.

9. A method of securing a closure on a vial, the vial having an open end defined by a vial rim, at least one outer thread and an outwardly projecting rib with the at least one outer thread being located between the outwardly projecting rib and the vial rim, the outwardly projecting rib and the at least one outer thread having respective first and second maximum width dimensions extending outwardly from an outer surface of the vial, with the first maximum width dimension being greater than the second maximum width dimension, and the closure having a top wall, a skirt wall having an inner surface and depending from the top wall, an inner thread provided on the inner surface of the skirt wall, and a stop surface provided on the inner surface of the skirt wall, with the inner thread being located between the stop surface and the top wall of the closure, the method comprising:

positioning the closure on the open end of the vial;

rotating one of the closure or the vial relative to the other so as to threadably couple the inner thread of the closure to the outer thread of the vial; and continuing the rotation until the stop surface engages the outwardly projecting rib so as to prevent advancement of the closure upon application of a torquing force onto the closure.

10. The method of claim 9, wherein the closure further comprises a septum pocket provided in the top wall and an opening formed through the top wall, the method further comprising the step of:

positioning a septum within the septum pocket with the septum being at least partially exposed through the opening.

11. The method of claim 9, wherein the open end of the vial further comprises a neck having the at least one outer thread located on the neck.

12. The method of claim 11, wherein the outwardly projecting rib is continuous about the circumference of the vial neck.

13. The method of claim 10, wherein the outwardly projecting rib provided on the vial and the stop surface provided on the closure are configured to cooperate when the closure is threadably coupled to the vial so that a generally constant force is applied to the septum around the circumference of the vial rim.

14. The method of claim 9, wherein the skirt wall terminates in a rim located opposite the top wall of the closure.

15. The method of claim 14, wherein the outwardly projecting rib provided on the vial and the stop surface provided on the closure are configured to cooperate when the closure is threadably coupled to the vial so that the rim of the skirt wall is aligned generally in a horizontal plane.

* * * * *